United States Patent [19]

Winch

[11] 3,996,874

[45] Dec. 14, 1976

[54] SURFACE CRAFT

[76] Inventor: Paul Winch, 31 Princes Court, Wembley, Middlesex, England

[22] Filed: Dec. 19, 1975

[21] Appl. No.: 642,492

[30] Foreign Application Priority Data

Dec. 20, 1974 United Kingdom ..... 55261/74

[52] U.S. Cl. ..... 114/123; 114/39; 114/61

[51] Int. Cl.[2] ..... B63B 43/14

[58] Field of Search ..... 114/39, 61, 66.5 F, 114/66.5 H, 122, 123; 9/1.2

[56] References Cited

UNITED STATES PATENTS

| | | | |
|---|---|---|---|
| 1,705,303 | 3/1929 | Nagy | 114/123 |
| 3,929,085 | 12/1975 | Mason | 114/123 |
| 3,937,166 | 2/1976 | Lindsay | 114/123 |

FOREIGN PATENTS OR APPLICATIONS

| | | | |
|---|---|---|---|
| 1,481,194 | 4/1967 | France | 114/123 |

*Primary Examiner*—Trygve M. Blix
*Assistant Examiner*—Jesus D. Sotelo

[57] ABSTRACT

A trimaran has its floats displaceable from normal extended positions to retracted positions close to the central hull and is arranged to have improved stability at large angles of heel with the floats retracted. The retraction is actuable responsively to the heel of the craft so that if the heel angle becomes undesirably large, the retraction of the floats produces a self-righting moment. The floats are also extendable when the craft has righted itself and as it continues underway. The crew can also effect retraction from a central position independently of the sailing attitude of the craft.

22 Claims, 23 Drawing Figures

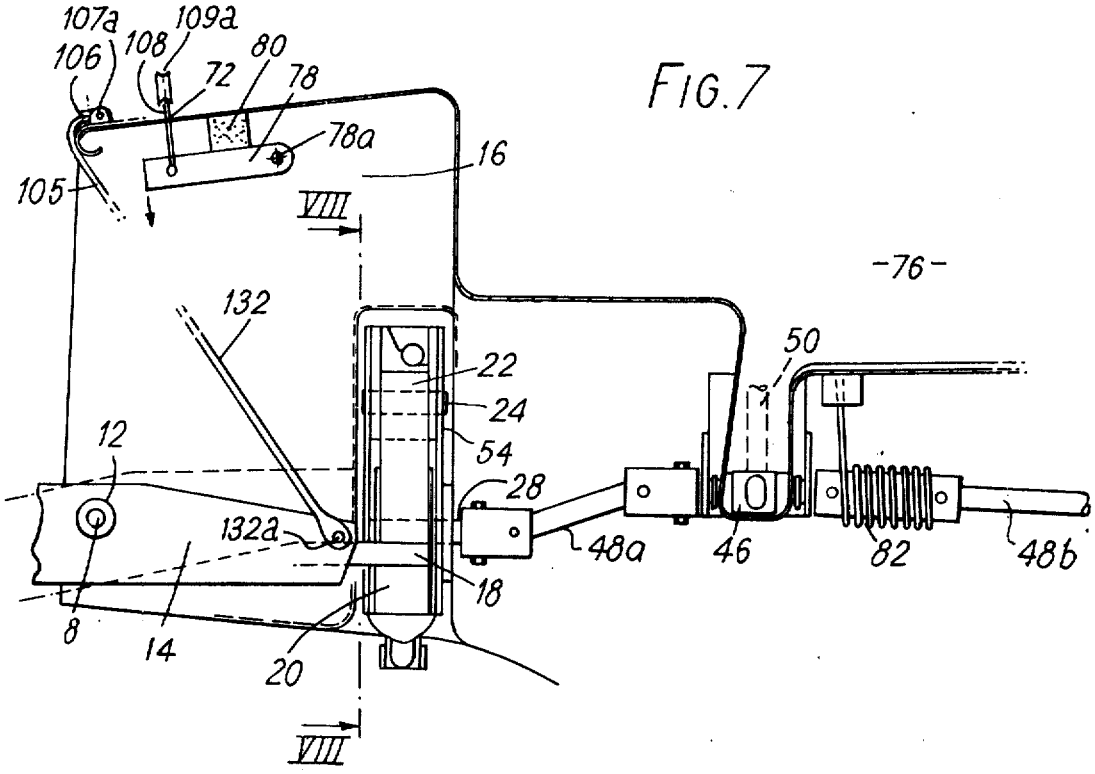
FIG. 7
FIG. 9
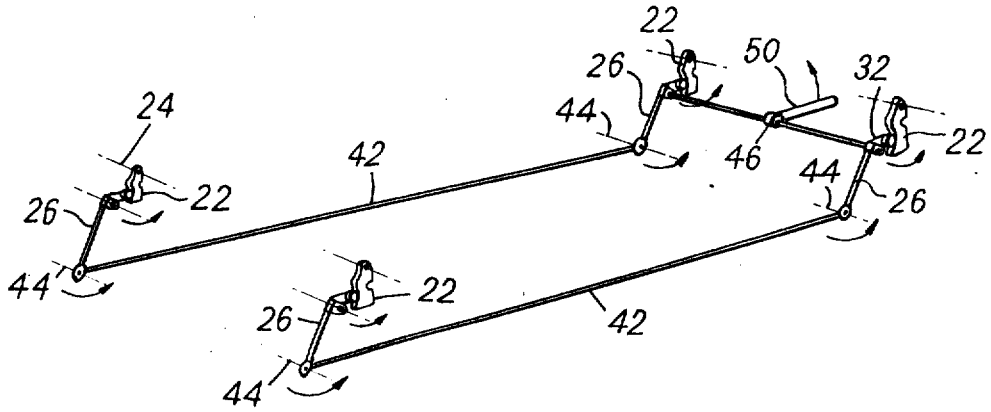

SURFACE CRAFT

BACKGROUND OF THE INVENTION

The invention relates to waterborne surface craft in the form of trimarans, i.e. having a main hull and two auxiliary hulls or floats (referred to hereinafter simply as floats) oppositely spaced from the main hull.

Such craft are often built as sailing craft and are noted for the high degree of stability they have in normal sailing attitudes due to the presence of the floats, In a state of capsize, however, the floats are a hindrance, making it more difficult to right the craft.

It is known to arrange that the floats of a trimaran can be lowered relative to the main hull for obtaining a more stable mooring configuration, the floats then simply resting freely on the water surface. Additionally, provision is sometimes made for retraction of the floats of a trimaran, in order to reduce the beam of the craft for road-trailing. As an example, the Piver "Nugget" trimaran is a design that has floats connected to the main hull by longitudinally extending pivots, expressly for the purpose of trailing the craft more conveniently, and a similar arrangement has been provided in the "Tees Clipper" of J. Shewell & Co. Ltd. (Motor Boat and Yachting, Apr. 16, 1971, p. 70). Another example, the "Ocean Bird" design of Honnor Marine Ltd. (Yachting Monthly, December 1966, p. 323) has floats each mounted on a pair of parallel links with vertical pivot axis so that they are displaced fore and aft as they move between extended and retracted positions.

In such designs the retraction of the floats is not intended to be performed while the vessel is underway, and indeed in many instances it can be carried out only when the vessel has been hauled out of the water and onto its trailer. The retraction of the floats and securing them in place is thus invariably performed manually and cannot be done with any degree of safety or convenience, if at all, by the crew in their sailing positions while the vessel is underway.

It has been proposed to provide a proa (i.e. a craft with a single outrigger float) with emergency self-righting capability in the event of capsize by connecting the arms of the float to the main hull by drop-in pins that are held in place simply by gravity. In the event of the craft being completely capsized the pins will drop out and the float is detached. In such conditions the crew cannot be relied on to retrieve and re-secure the float while righting the craft and the main hull must be so designed and provided with a ballast keel that it can be sailed without the float (Yachting World, September 1967, pp 416–418). The arrangement thus clearly does not allow for the float to be locked again in its extended position while the craft is underway, particularly if sailing in rough water as is most likely if a capsize has occurred and when the detached float will probably be irretrievable, and is thus simply an emergency measure. Nor is the arrangement capable of stabilising the craft in any condition other than complete capsize since the pins will only fall out when the craft has overturned. Moreover, although the release of the floats in such a condition is necessarily arranged to occur automatically, if it failed to operate it would be impossible for the release to be effected manually while the craft is underway.

It is an object of the present invention to provide means for retraction and extension of the floats of a trimaran that can be utilised while the vessel is underway.

It is another object of the invention to provide retraction means that are operated automatically in dependence upon the heel of the craft, whereby correction of an unstable situatioin can be initiated at an early stage without relying on action by the crew.

It is a further object of the invention to provide means whereby such automatic retraction of the floats can be overriden simply and effectively by the crew whereby to permit them to exercise control of this function while the craft is underway, if they judge it to be desirable.

SUMMARY OF THE INVENTION

According to the invention, there is provided a trimaran wherein each of a pair of laterally opposite floats is connected to a main hull through pivot connection means for movement of the floats relative to the hull between an outwardly extended position and a retracted position close to the hull, locking means being provided to maintain the floats in their extended positions and release means actuable by means responsive to the heel of the craft while the craft is underway being adapted to act on said locking means when a predetermined angle of heel is exceeded whereby to release the floats for displacement to the retracted position, the arrangement of the hull and the retracted float or floats being such that a self-righting moment is obtained between buoyancy forces and gravity forces at large angles of heel, and means being provided for returning the floats to their extended positions.

More particularly, each float may be connected to the main hull by arms that have pivot joints on an axis extending substantially longitudinally of the craft for the float to be pivotable downwards and inwards to the retracted position. Alternatively the arms may each have spaced pivot connections, to the main hull and to the float respectively, in which the pivot axes are upwardly directed whereby the float is displaceable in a laterally extending plane with arms acting as pivot links: conveniently in this instance the inward retraction of the float takes place jointly with a rearwards displacement.

The release of the locking means may also be arranged to be made manually to override the heel-responsive means when required, said manual operation being capable of being effected while the craft is underway.

BRIEF DESCRIPTION OF THE DRAWINGS

The invention will now be described, by way of example only, with reference to the accompanying drawings, in which:

FIG. 7 is a cross-sectional view on the line VII—VII of FIG. 6, FIG. 9 illustrates the interconnections between the detents of the mechanism of FIGS. 6 to 8.

DESCRIPTION OF THE PREFERRED EMBODIMENTS

Figure 1:
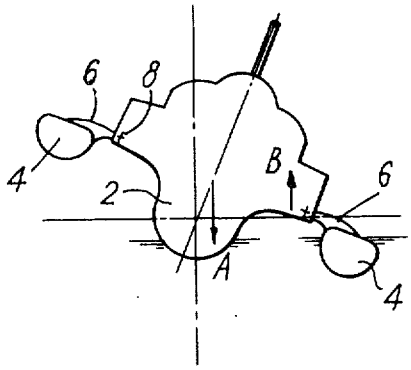
FIGS. 1 to 3 show in cross-sectional outline, a trimaran at various angles of heel, with its floats in their extended positions.

The embodiments of the invention illustrated and described below all relate to sailing trimarans, and FIG. 1 shows in cross-sectional outline a trimaran according to the invention in a typical sailing attitude heeling under the action of wind on the craft's sails (not shown). The craft comprises a main hull 2 to which floats 4 are attached by arms 6 which have pivot connections on longitudinal axes 8 but which are normally held fixed relative to the main hull in the positions of maximum extension shown. The heel of the craft immerses one of the floats and under normal sailing conditions the buoyancy from this is sufficient to stabilise the craft.

Should the angle of heel become excessive, the righting moment from the buoyancy force will reduce, and beyond a certain angle the buoyancy force from the immersed float will tend to overturn the craft completely if it remains in the extended position shown in FIG. 1. By providing for pivoting of the floats towards the hull while the craft is underway at a large angle of heel, this can be avoided and by suitable design of the craft with respect to its weight distribution in relation to the modification of the centre of buoyancy so induced the craft can retain a self-righting capacity through angles of heel well in excess of 90°.

As will be described in more detail below, the arms are arranged to pivot automatically when a predetermined angle of heel is reached and they may be manually released, while the pivoting movement can be assisted by resilient biasing means. The effects will be described first with reference to FIGS. 2 to 5.

Figure 2:
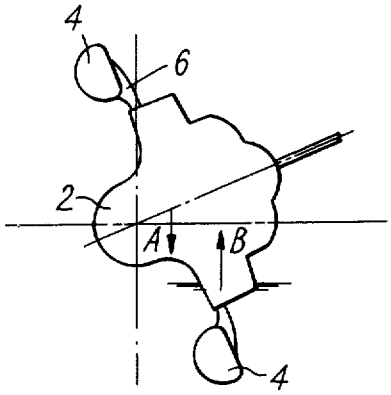

FIG. 2 illustrates the craft at a large angle of heel less than 90°. If the floats are freed for pivoting inwards and downwards the upper float will be able to fall under its own weight, which will have some slight stabilising effect since the wind force on it will be mainly avoided, but the buoyancy force on the lower float will only retract the float against the hull when it acts on the appropriate side of the pivot axis and the lower float will therefore remain extended until the angle of heel increases. In the region of 90° angle of heel both floats would tuck into the main hull due to the weight and buoyancy forces acting on them, and release at an angle somewhat beyond 90° (FIG. 3) allows the buoyancy force on the immersed float to cause it to retract although now the weight of the raised float may so act about its pivot as to resist retraction.

Figure 3:
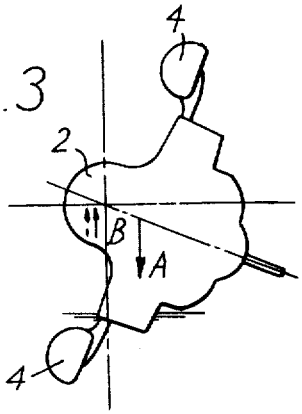
Figure 4:
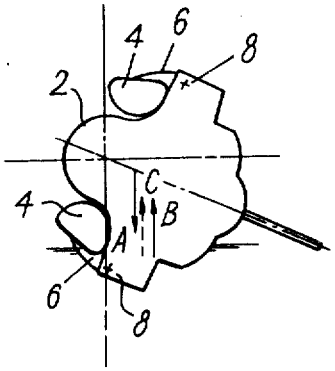
FIGS. 4 and 5 show the craft with its floats in downwardly and inwardly retracted positions at angles of heel corresponding to those in FIG. 3 and FIG. 2 respectively.
Figure 5:
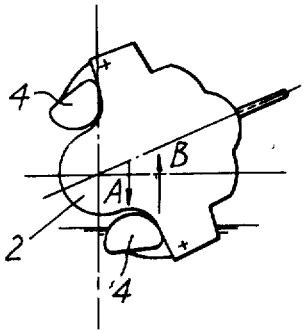

FIG. 3 illustrates also how the weight of the craft, represented by arrow A, and the resultant buoyancy force, represented by arrow B, produce a couple when the floats are fixed in their extended positions that tends to overturn the craft (the broken arrow C shows the buoyancy for excluding the modifying effect of a hollow buoyant main mast). With the craft at the same attitude but the floats retracted (FIG. 4) these forces produce a righting couple. Such a self-stabilising couple is also produced at lesser angle of heel, as FIG. 5 shows, although as the heel reduces the magnitude of the couple may be less than that obtained with the floats extended.

It will be appreciated that variations in the configuration of the vessel can mean that the effects described above will occur at somewhat different angles of heel, and can be calculated in known manner, the foregoing description being simply an illustrative example. It is also possible to modify the sequence of operation by biasing the floats on their pivots so that they will move inwardly immediately upon release. Also stability at very large angles of heel beyond 90° can be improved by providing a masthead float.

It may be advantageous to provide for the release of both floats to cause initially only the lowering of the raised float if said release occurs at so small an angle that the submerged float is making a significant contribution to the righting forces acting on the craft, or for the raised float to be released before the submerged float.

The means for retaining and releasing the floats will now be described in more detail, FIGS. 6 to 9 showing one form of mechanism that can be provided for this purpose. Each float 4 is mounted on the main hull 2 by four arms 6 having pivot connections 12 with the hull 2 on the common axis 8. Extensions 14 on two of the arms of each float project into outwardly and downwardly open compartments 16 in the hull sealed from the watertight spaces of the hull. The inner end of each extension 14 terminates in a spigot or pin 18 disposed above a fixed bottom stop 20 that determines the upper or fully extended position of the float. The pin 18 is also normally engaged and held by a detent 22 pivoted on a transverse axle 24 so that the two detents act in parallel to secure the float in its extended position, as in FIGS. 7 and 8. (It is of course possible to have a single holding detent for each float, or indeed more than two detents acting in parallel).

Figure 8:
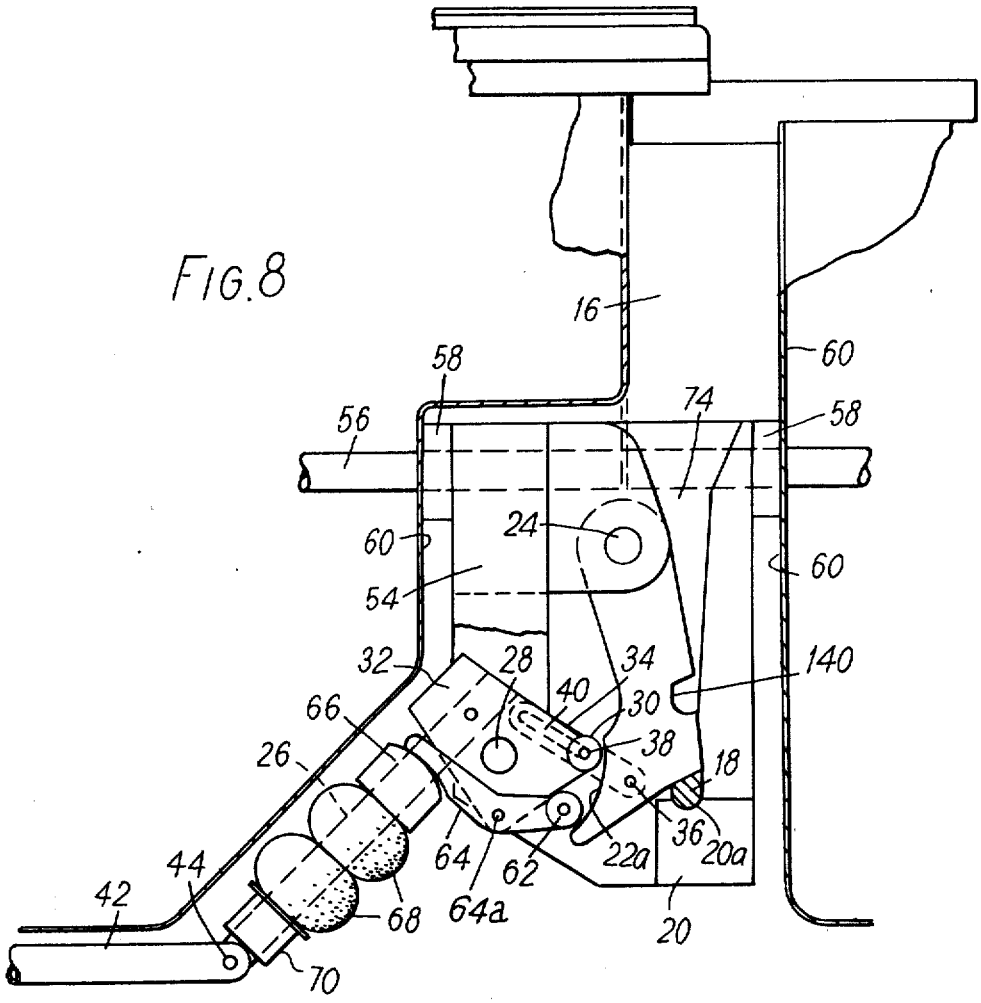
FIG. 8 is a cross-sectional view on the line VIII—VIII of FIG. 7.

Each detent 22 has associated with it a locking arm 26 pivotable on a fixed transverse axle 28. The arm is shown in its final locking position in FIG. 8, with a roller 30 on head 32 fixed to the arm engaging bearing face 22*a* of the detent to hold the pin 18 firmly against its bottom stop. From this position the arm can pivot anticlockwise (as indicated in FIGS. 8 and 9) causing the detent to pivot clockwise away from the pin because of a connecting slotted link 34 having a pivot connection 36 with the detent 22 and pivot axle 38 of the roller 30 engaging a slot 40 in the link to connect it to the head 32 in a way that permits some lost motion between the detent and its locking arm. Said pivoting of the arm thus lifts the detent permitting the pin 18 to rise and, thereby, the float to retract.

As can be most clearly seen in FIG. 9, the two detents of each float have their locking arms linked by a tubular tie rod 42 running fore and aft and pivoted to them at 44 so that the arms 26 of each float swing together. In addition a control stub shaft 46 (FIG. 7) extending athwartships is connected by universally jointed intermediate shafts 48*a* 48*b* to the locking arm axle of the rear detent of each float so that rotation of the shaft fixed thereto locks and releases both floats jointly. A centrally located operating lever 50 on the stub shaft controls the locking and release of the floats.

The detents 22 are made of Tufnol (Trade Mark) and the pins 18 are of stainless steel. The engaging face between each detent and pin is inclined to the direction of displacement of the detent about the axle 24 in its initial movement from the locking position, the inclination corresponding to the angle of friction between Tufnol and stainless steel so as to reduce the force needed to disengage the detents. The bottom stop 20 is formed of Tufnol also and has a recess 20*a* in its upper face that the pin is received in, whereby it is supported against longitudinal loads from the detent.

The pivot connections 12 take the longitudinal loads from the floats but not necessarily without some displacements occurring. The axles 24, 28 are therefore mounted on a respective carrier 54 for each detent and its locking arm and the carrier is supported on a stainless steel tube 56 between resilient blocks 58 between transversely directeed bearing faces 60 of the compartment 16 that allow some fore and aft movement.

Accommodation of a measure of misalignment between the detents and their locking arms is also desirable, both to simplify initial assembly and to allow for wear and movements against the blocks 58 when in use, the detents also preferably being engageable independently of each other. For this purpose, while each roller 30 is on a fixed axis on its locking arm head 32, immediately below it there is a pilot roller 62 rotatably mounted on one end of an auxiliary lever 64 pivoted at 64*a* on the locking arm head, the other end of the lever engaging a tubular abutment 66 slidable on the arm 26 and urged into engagement with the lever 64 by solid rubber spring elements 68 compressed between the abutment and a rear stop 70. The pilot roller 62 is thus capable of some pivoting movement about the axle 64*a*.

The operation of the locking lever mechanism can be considered starting from the inoperative position in which the operating lever 50 is raised to a vertical position, when the rollers 30, 62 are spaced above the detent bearing face 22*a* and the detent is drawn away from the path of movement of the pin 18 by the slotted link 34 between it and its locking arm 26. If the float has been fully retracted, its pin will lie close to the extreme outer edge of the deck moulding 72 forming the top of the compartment 16 and as the float is extended, the pin pivots downwards, entering the range of action of the detent through tapered throat 74 of the carrier. With the float fully extended, the pin lies on the bottom stop 20 and the detent is then pivoted by the locking lever to secure it in place there.

The first part of the downwards movement of the operating lever 50 release the detent from the constraint of the slotted link connection and after some 30° of operating lever movement, the pilot roller 62 comes into engagement with curved bearing face 22*a* of the detent. Since the roller 62 is spring-biased and can rock relative to the head 32, the precise initial relative position of the detent and its locking lever mechanism is not critical but as the roller 62 begins to bear on said face 22*a* the detent will be urged towards its locking positoin by a force determined by said bias. Each of the detents of either float is thus engaged substantially independently of the other detent of that float. After a total of some 60° of movement of the operating lever the roller 30 is brought against the bearing face 22*a* so that the detent is positively locked by a final part of the movement of the operating lever to the horizontal.

The lever 50 is located in the cockpit 76 of the craft or other central position, i.e. a position at which it is immediately at hand for operation by a crew member while the craft is underway. The lever is also arranged to release the floats automatically when the craft passes a predetermined angle of heel so that this action can take place without intervention from the crew.

For this purpose the release mechanism is biased towards a float-releasing position and is restrained from moving to that position by gravity-operated means, as is specifically illustrated with particular reference to FIGS. 7, 9, 10 and 11. Thus, a coil spring 82 acts between the hull and the intermediate shaft 48*b* to bias the lever 50 upwards and both intermediate shafts 48*a*, 48*b* toward the position at which the detents 22 are released. The lever 50 carries a roller 84 held under a lip 86 of a rotary latching dial 88 to restrain the lever from being lifted and so prevent release of the detents. The dial 88 is fixed to rotary shaft 90 extending fore and aft on fixed bearings and also having a pendulum weight 92 fixed to it so that the dial does not rotate wth the heeling of the craft. The lip 86 extends around only a portion of the circumference of the dial 88 and when the roller 84 runs off the end of the lip as a predetermined angle of heel (e.g. 75°) is exceeded, the spring 82 is able to pivot the lever and rotate the intermediate shafts 48*a*, 48*b* to release the floats. The dial 88 has a scale face 94 indicating the angle of heel and on this face are a pair of lugs 96 for turning the member by hand, thus providing a manual override release.

Figure 10:
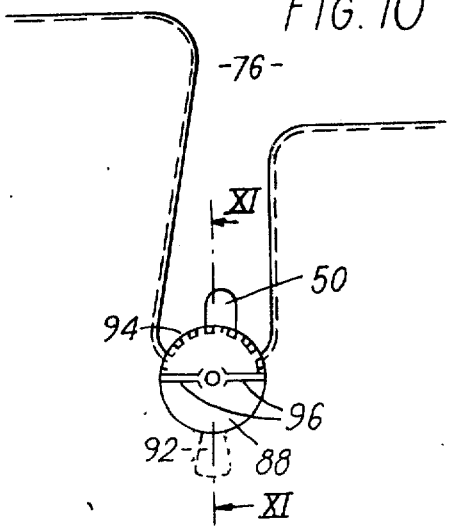
FIG. 10 is an end view of an automatic mechanism for release of the floats.
Figure 11:
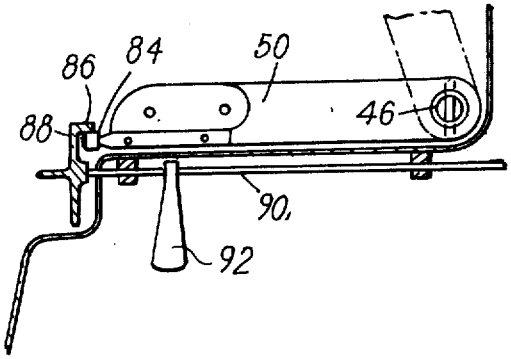
FIG. 11 is a schematic and simplified cross-sectional view on the line XI—XI of FIG. 10.
Figure 12:
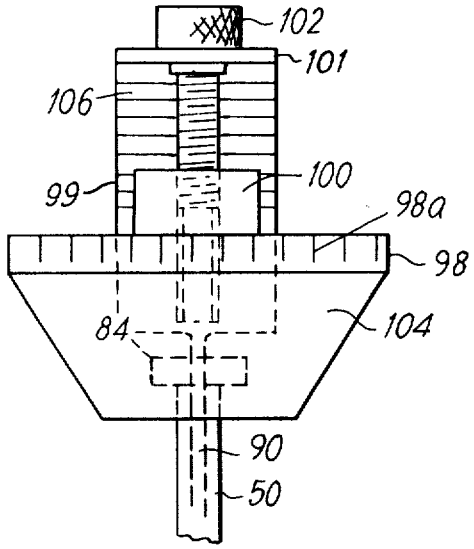
FIG. 12 is a plan view of a modification of the mechanism of FIGS. 11 and 12.

FIG. 12 shows a modification of a part of the construction of FIGS. 10 and 11 in which the heel angles at which the floats are released can be quickly and easily adjusted. The shaft 90 with its pendulum weight now has a rotary dial 98 keyed to it to be movable axially of the shaft although still rotationally fixed to it and having a scale 98*a* to be read against a mark (not shown) fixed to the hull to indicate the heel of the boat. For said axial movement, an adjustment nut 100 is fixed to a dial 98 restrained from rotation. A scale carrier 99 fixed to the shaft 90 extends through the dial 98 and has a feed screw 102 held axially on its front flange 101. The screw 102 is rotatable on the flange and engages the nut so that its rotation moves the nut and the dial 98 axially. The lever roller 84 is held under dial lip 104 which now tapers axially with respect to the shaft 90. As the dial is axially adjusted by the feed screw, therefore, the angular movement of the dial needed to release the lever will vary. A scale 106 on the carrier 99 indicates the heel angle setting at which release will occur. Of course, manual override of this arrangement is possible in the manner already described.

Figure 6:
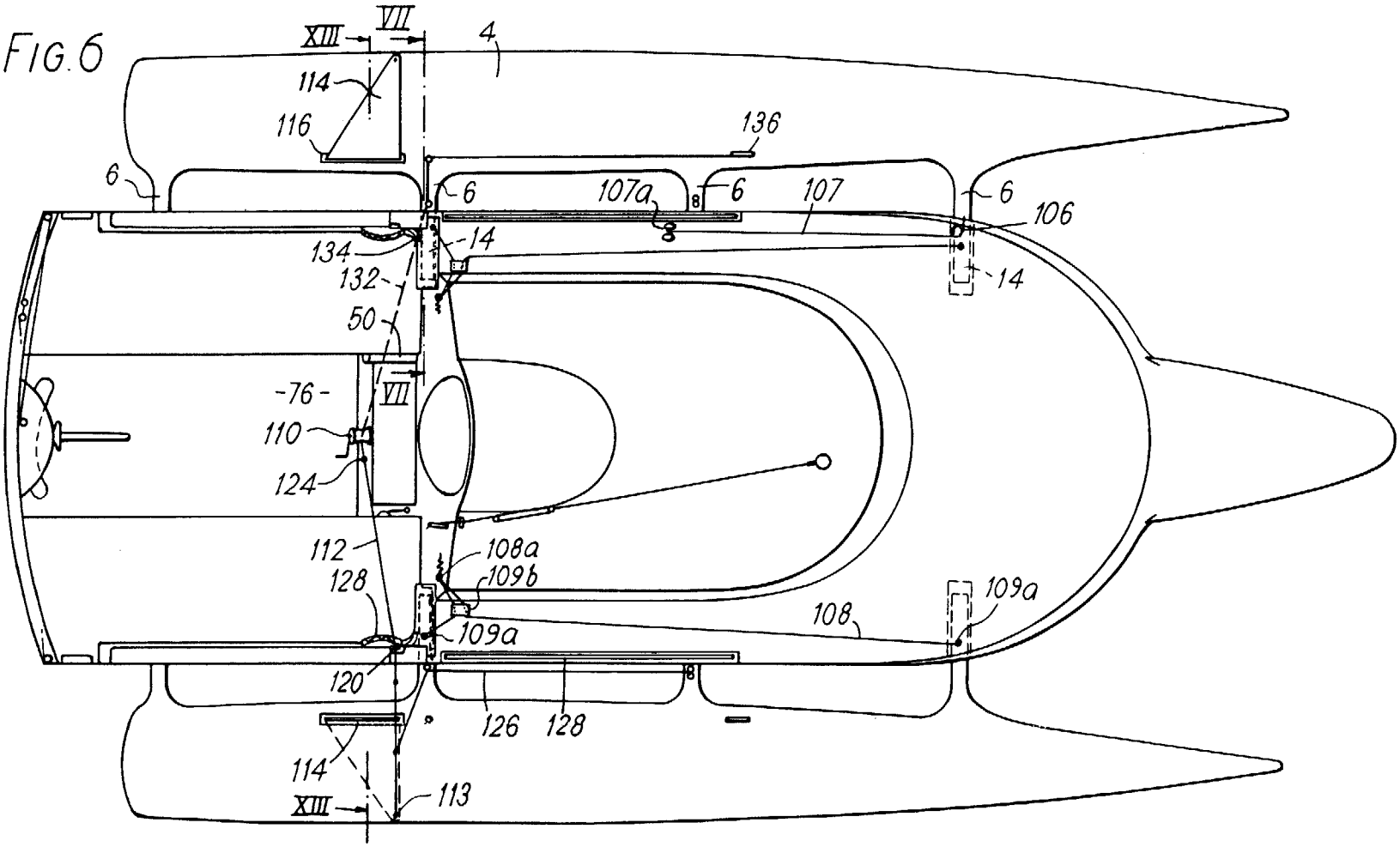
FIG. 6 is a plan view of the craft showing in more detail the means for retention and displacement of the floats according to the invention.

Although under many conditions and attitudes of the craft the floats will be biased to their retracted positions when the locking mechanism is released, as by the weight of the lifted float and the buoyancy of the submerged float, it may be desirable in a configuration such as that described above with floats retracting inwardly and downwardly, to employ external biasing means. Such means are shown in FIGS. 6 and 7 where at each side of the craft a lanyard 105 attached to the inner end of the forward extension 14 is led through a fairlead 106 to a shock cord 107 anchored to the hull at 107*a*. The tension in the shock cord when the float is extended acts therefore on the float arm to swing the float downwards about the pivot 8.

As each float moves to the retracted position the forward extension 14 strikes against a holding catch 78 pivoted at 78*a* in the upper region of the float arm compartment 16 and a rubber block 80 above the catch allows the catch to rise so that the float arm moves past the catch to be trapped by it, the float then being maintained retracted. For extending the floats, each catch is connected to a lanyard 108 that runs through fairleads 109*a* 109*b*, being retained in the latter by a knot 108*a*, so that the crew can lift the catches from a central position by pulling on the lanyards to release the detents 78 in preparation for re-extending the floats.

A winch 110 is provided in the cockpit for returning the floats to their extended positions, for example after righting the vessel from a capsize. The extension and retraction mechanism is the same for each float, although for simplicity some of the elements are shown on one side only in FIGS. 6 and 13. An extension lanyard 112 for each float has one end 113 permanently attached to the outer edge of its float and in order to provide the necessary leverage when the float is retracted, the lanyard 112 acts on a strut 114 hinged at 116 to the float to normally lie flat on the float (as shown on the port float in FIGS. 6 and 13). As the lanyard is drawn in by the winch a knot 118 on the lanyard engages the strut to lift the strut upright (as shown on the starboard float in FIGS. 6 and 13). As the crew may have to extend the floats in rough water after a capsize, it is desirable to have the extension lanyards permanently rigged. Each lanyard is thus run through a closed fairlead 120 on its adjacent cockpit coaming 122, knot 124 on its inner end ensuring that the lanyard does not run out from the fairlead and that it can always be reached from the cockpit. Shock cord 126 connected to the lanyard draws in the loose length when the lanyard is not in use, and its tension also folds the strut 114 flat onto the float. A net 128 provides a stowage for the remaining lanyard fall beyond the knot 124.

Figure 13:
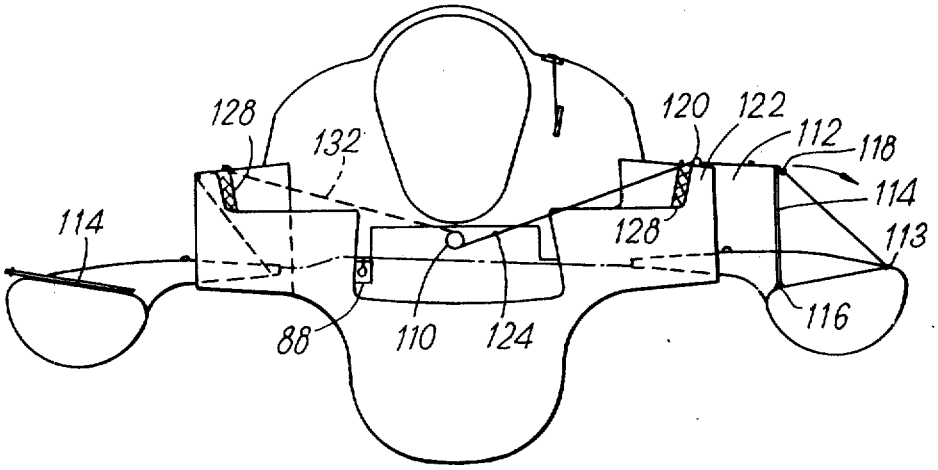
FIG. 13 is a simplified cross-sectional view on the line XIII—XIII of FIG. 6.

The winch 110 can also be used to retract the floats when the craft is in a normal attitude — for instance in order to reduce beam in harbour. FIG. 13 shows retraction lanyard 132 attached to the inner end of the rearward of the extensions 14 of the float arm 6 (as with the float extension means a similar mechanism is provided for both floats to be operated by the winch 110, although for simplicity and clarity the elements are shown for one float only) and run via snatch fairlead 134 on the coaming to the winch 110. Once the catches have been released, the retraction lanyards can be reeled onto the winch both at the same time if needed, to draw the floats under the hull. The lanyard 132 is lead stretched along its float to cleat 136 (FIG. 6) when not in use. It may be mentioned here that the point of connection 132*a* of the lanyard 132 to the rear float arm corresponds to the point of connection of the retraction lanyard 105 to the forward float.

The winch-operated mechanisms described operate on each float separately so that the float can each be extended independently of the other. It is desirable to take measures that ensure that as one float is extended and latched in its extended position, the other float will not be released if already in its extended position. This can be achieved in the described construction by virtue of the slotted link 34 introducing some lost motion in the linkage to the detents when the lever 50 is 30° from the vertical. The operation of the winch extending a float will then cause the float extension pins 18 to push the associated detents away from them, against the spring bias, on the detents, until they fall to their end position. The lost motion of the mechanism ensures that the detents of the other float are undisturbed as this takes place.

Referring again to FIGS. 7 and 8 the retention of the pins 18 against the bottom stops 20 by the detents 22 maintains the floats in a correct sailing position but when the craft is moored it may be preferable for both floats to be lowered into the water surface to keep the craft steady. The detents therefore are each provided with a notch 140 on the inner edge in which the pins 18 can be entered to secure the floats in a partly lowered position that gives this result. To bring the pins to this position the retraction lanyards 132 can be used to lower each float in turn. The form of notches 140 permits the pins to be pushed out of them, against the detent spring bias, if the pins should seat in the notches as the floats are being extended to the sailing position. The pins can however be locked in place in the notches 140 by the rollers 30 of the locking levers being brought into engagement with the detents in the manner already described. It is of course also possible to have a quite separate mechanism for setting the floats in a mooring position.

Figure 14:
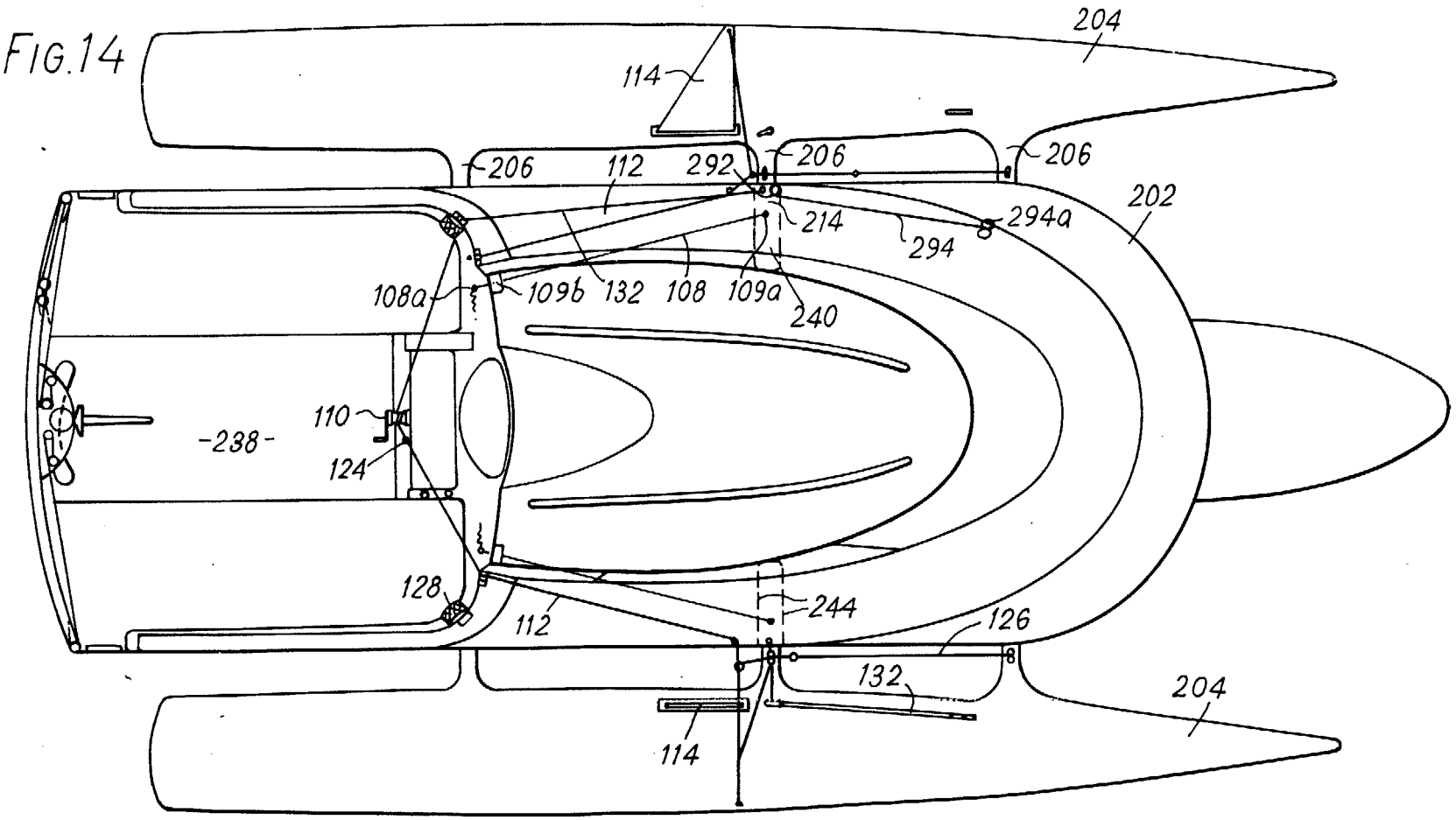
FIG. 14 is a plan view of a second embodiment of craft according to the invention.
Figure 15:
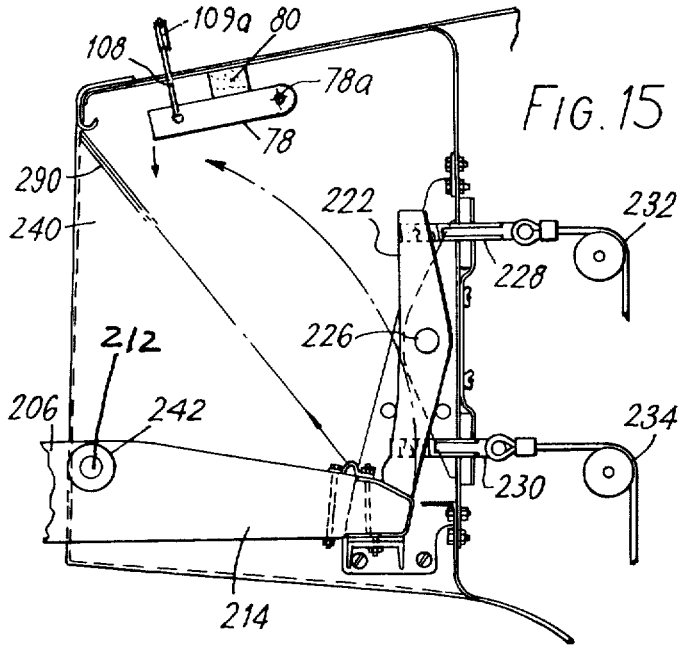
FIG. 15 is a cross-sectional view of this second embodiment in a region analogous to that shown in FIG. 7.
Figure 16:
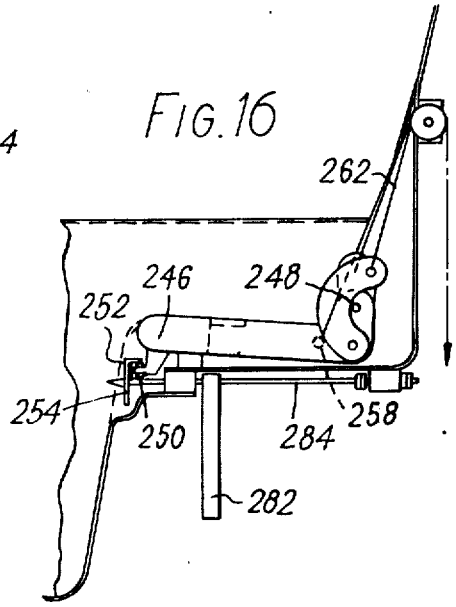
FIG. 16 is a side view of the automatic release mechanism of the second embodiment.

An alternative embodiment of float release mechanism is shown in FIGS. 14 to 16, employing detents 222, also of Tufnol, to lock the floats 204 in their extended positions but in this instance the detents 222 are pivoted on fore and aft axles 226 and have connections 228, 230 above and below the pivot to respective cables 232, 234 for the locking and unlocking movements. The arms 206 of each float 204 are mounted, similarly to the previous example, on pivot connections 212 having a common fore and aft axis and an extension 214 of the arm associated with each detent 222 is located in an outwardly and downwardly open recess 240 in the hull, Tufnol spacing washer 242 spacing the arm clear of front and rear walls 244 of the recess. Only one arm of each float has a locking detent 222 associated with it but it is of course possible to provide in this mechanism respective detents to operate in parallel on a plurality of arms of each float, as in the previous example. Similarly to that previous example, the bottom face of the detent locks against the upper face of the tip of the float arm extension with a wedging action.

The detents are controlled by a dial release arrangement similar in many respects to that in the previous embodiment, and also located in the cockpit 238 of the main hull 202 or other central position where it is immediately at hand for operation by a crew member while the vessel is underway. A lever 246 pivoted to the hull on a transverse axis 248 has a roller 250 normally retained under the lip 252 of the release dial 254 that may be of the form described with reference to FIGS. 10 and 11 or FIG. 12. At spaced connections 258, 260 on the lever are cables 262, 264, the two cables acting in opposite directions about the axis 248, i.e. the connection 258 rising when the connection 260 falls, and vice versa. The cable 262 is connected at its other end to the boat hull through a release spring 266 the tension in which provides the energy for pivoting the lever upwards to release the detents when the lever roller 250 is freed from the dial lip 252. The cable 264 has a forked connection 268 with the two cables 234 running to the connections 230 at the lower ends of the respective detents.

The dial release arrangement also includes, for each detent, levers 272 pivoted substantially coaxially with the lever 246 and connected to the cable 232 running to the upper end connection 228 of its respective detent by a curved link 274. The in direct connection of the lever 272 to the cable by way of the curved link 274 provides clearance from the pivot support of the lever while placing the cable connection 276 so as to rise and fall together with the connection 270. Intermediate the length of each cable 232 is a locking spring 278 the extension of which is limited by a loop 280 of the cable between its ends. The springs 278 urge the levers 272 downwards about their pivots when the levers are in the locked position but lugs 280 fixed to the levers near their free ends overlie the lever 246 which thus limits their downward movement. In the condition shown, the tension in the locking springs 278 has also drawn the detents into engagement with the float arms thereby forcing the floats into their extended positions.

When the roller 250 is released from the dial lip, whether by manual rotation of the dial or by the pivoting of the pendulum weight 282 fixed to the dial shaft 284 to rotate the dial 254 relative to the hull with the heel of the boat, the release spring 266 acts with some force to pivot the lever 246 upwards and the abutment of the lever 246 with the lugs 280 causes the levers 272 to be entrained upwards. The effect is to allow the tension of the release spring 266 to act on the cable 264 and to relax the tension exerted by the locking springs 278 on the cables 232. As a result the detents are pivoted out of engagement with their float arms and the floats are able to retract under the action of their own weight or buoyancy in the heeled condition of the craft.

It will be understood that entirely analogously to the earlier example the pendulum weight is able to cause automatic release of the locking mechanism at a predetermined, and possibly adjustable, angle of heel, or the release can be effected by manual rotation of the dial. As in that earlier example the floats are biased to their retracted position by a lanyard 290 running from the inner end of each float arm extension 214 through a fairlead 292 to a forwardly extending shock cord 294 attached to the hull at **294*a* and providing the resilient biasing force for retraction. Catches for holding each float when retracted, with release means operable from a central location, are provided in an essentially identical form to that in the first-described example and is indicated in FIGS. 14 and 15** by the same reference numbers.

When returning the floats to their extended position the lever 246 is first depressed and its roller re-inserted under the dial lip. This re-tensions the release cable and ensures that there is sufficient slack in the cables 234 to permit the movement of the lower ends of the locking detents into engagement with the float arm extensions. The locking springs 278 do not act on the upper ends of the detents at this stage since their associated levers 272 are still raised but preliminary engagement springs 286 are connected between the cable 262 and the respective cables 232 and are tensioned by the lowering of the lever 246, the effect being that a relatively light spring force is applied to the cables 232 so urging the lower ends of the detents outwards.

As a result, if a float, being retracted, is now extended, the float arm extension will strike the detent that has already been pivoted to its locking position by its preliminary engagement spring, but because it is held there by only a light force the detent will be deflected and will snap into place over the arm as soon as the float reaches its fully extended position. Thereupon the detent can be fully locked in place to fix the float in its extended positions by lowering the lever 272 to bring its lug 280 against the lever 246, so tensioning the locking spring and applying the detent with a wedging force and, in the final stage of the movement, exerting an over-centre action on the lever 272 urging its lug 280 against the lever 246. Both floats can be locked in their extended positions simultaneously if desired.

FIG. 14 also illustrates a winch-operated float extension and retraction means by which the floats can be brought to their extended positions to be locked in place. These means are substantially the same as the float extension and retraction means in the earlier example, comprising retraction lanyards 132 and extension lanyards 112, and need no further description here except to mention that the lanyards are carried forward of the cockpit to their attachment to the floats in order to place said attachments close to the detent-locked float arms.

Figure 18:
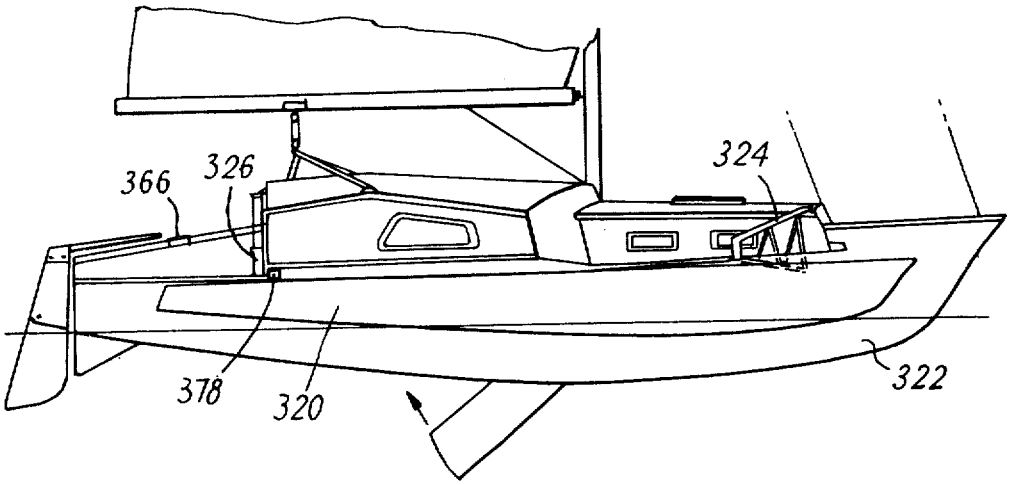
FIGS. 18 and 19 are side and plan elevations respectively of a further embodiment of a trimaran according to the invention.
Figure 19:
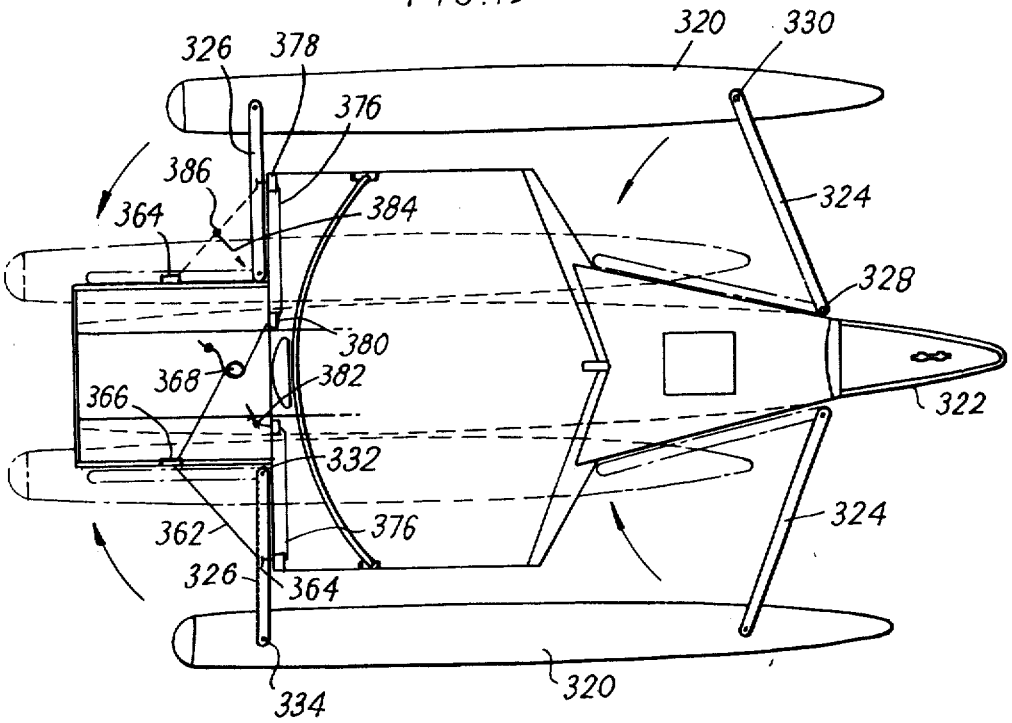

A further embodiment of the invention is shown in FIGS. 18 and 19. Unlike the preceding examples where the floats are pivotable about longitudinally directed axes, the floats 320 in this instance are each connected to the main hull 322 by front and rear pivot links 324, 326 having their ends pivoted on parallel axes that are directed vertically or at a small angle to the vertical, the front links having inner and outer pivots 328, 330 and the rear links having inner and outer pivots 332, 334. Each float is thereby displaceable inwardly and rearwardly from the extended position to the retracted positoni shown in dotted lines. It may be noted that the pivots of each float define, in plan, a quadrilateral with no parallel sides and in general it will be desirable to provide a configuration with not more than one pair of opposite sides parallel to ensure that the linkage cannot go to an over-centre state when the float retracts and from which restoration may be difficult.

The means for permitting or causing retraction and extension of the floats can be generally similar to those described in the earlier examples and as in those examples there is a common release mechanism for both floats. With the configuration of the present example, both floats will retract straight after release, the raised float falling under its own weight and the immersed rising due to its buoyancy.

Figure 17:
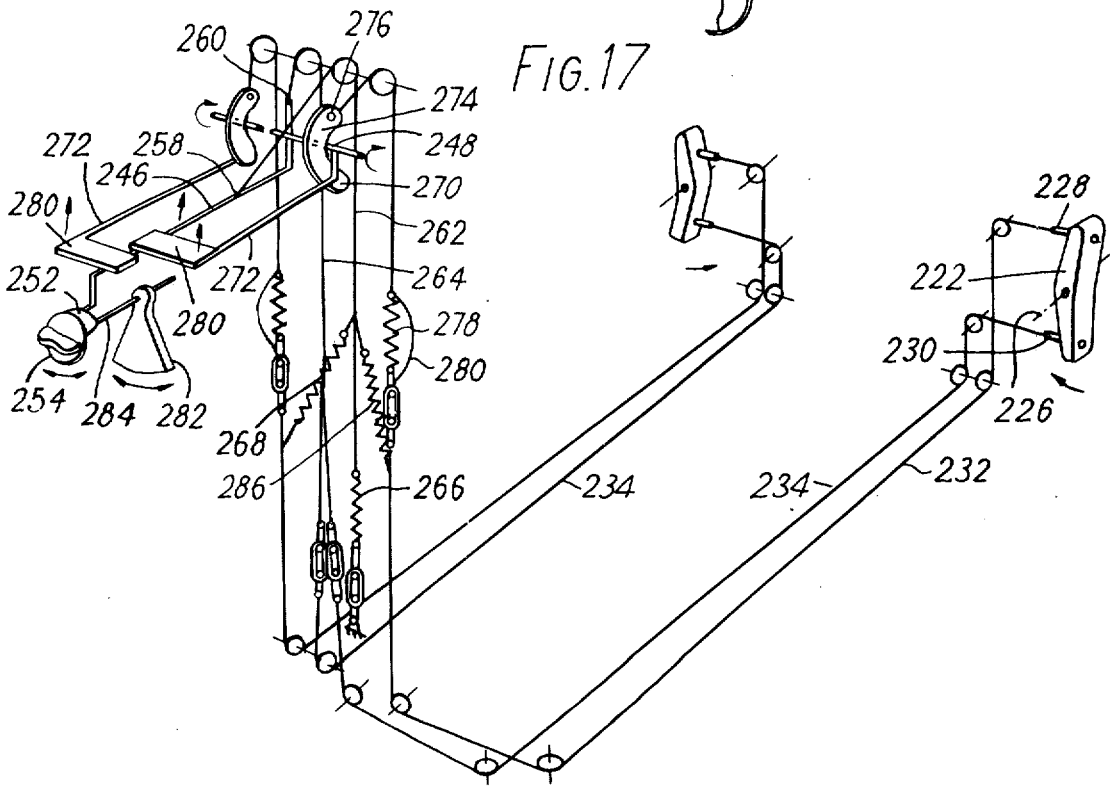
FIG. 17 illustrates the connections in the second embodiment between the locking detents and the release mechanism.
Figure 20:
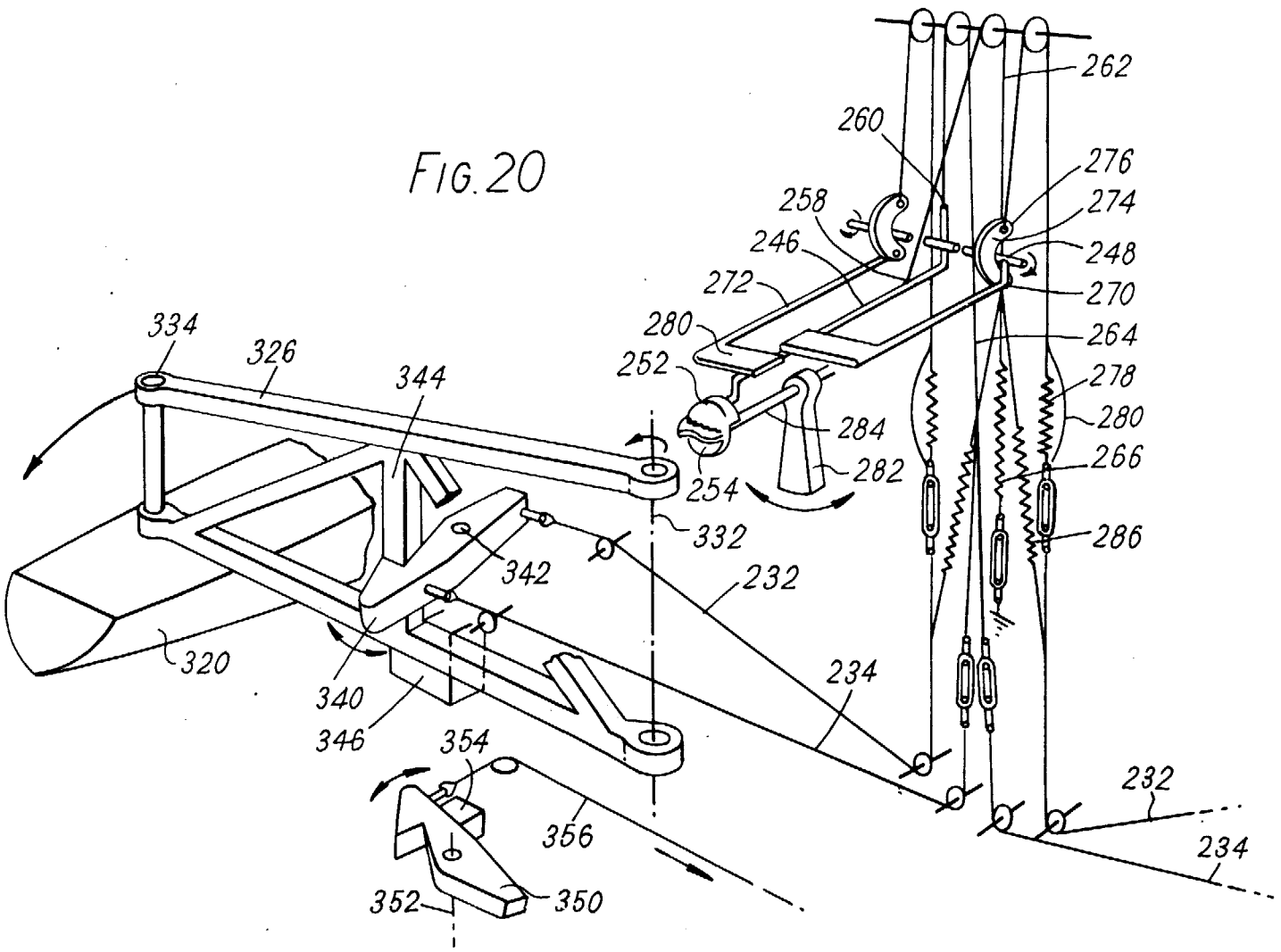
FIG. 20 illustrates the locking mechanism of said further embodiment.

The means for retraction and extension of the floats can be generally similar to those already described in the earlier examples and FIG. 20 illustrates by way of example an arrangement analogous to that shown in FIG. 17, similar parts being indicated by the same reference numbers. A hooked detent 340 pivotable on a substantially vertical axis 342 now replaces the detent 222 and latches onto an upright 344 of rear arm 326 of its float, holding the arm against a stop 346 fixed to the main hull to lock the float in its extended position. It is, of course, similarly possible to arrange the detents of the arrangement shown in FIGS. 7 to 9 on substantially vertical axes i.e. the pivot 332 now corresponding to the pivot 8 in FIG. 7, and further illustration or description of the adaptation of this earlier embodiment is unnecessary as it will be readily understood by one skilled in the art. As has also been mentioned in the earlier embodiments, it is possible to have more than one detent acting on each float, e.g. locking the front and rear pivot arms 324, 326 respectively.

For retaining the floats in their retracted positions an auxiliary hooked catch 350 is pivoted to the main hull on an axis 352 parallel to the axis 342. A rubber spring 354 biases the catch to engage the upright when the float is retracted and a pull cord 356 is provided to withdraw it from the upright when the float is to be extended.

Means for winch-operated retraction and extension of the floats are provided similarly to the corresponding means in the earlier-described embodiments. The float retraction lanyards 362 (shown in its operative state on the starboard side only and able to be stowed on the float or the rear pivot arm when not in use) is connected at 364 to the pivot arm 326 and runs via fairlead 366 to winch 368. The detents 340 must of course first be released when the floats are retracted by these means.

The float extension lanyards 376 (shown operative on the port side and stowed on the starboard side) are also connected to each pivot arm at 364 and run through closed fairleads 378, 380 on the hull to the winch 368. A knot 382 keeps each lanyard in the fairleads when it is not wound on the winch and a shock cord 384 is connected to each lanyard at 386 to prevent slack in the lanyard and gather it to the pivot axis when not in use.

With retraction of the floats in the example of FIGS. 18 and 19, the centre of gravity of the craft moves rearwards and the resultant stern-low bow-high attitude can be of advantage when inverted. The trim of an inverted craft will depend, of course, on a number of other factors, including the shape of the main hall for instance and it is possible to achieve a stern-high or a stern-low trim, whichever may be desirable with a particular configuration, even when the floats do not move longitudinally, as in the earlier illustrated embodiments. In general terms the advantage of the main hull being longitudinally inclined when inverted arises because if a large generally flat area of the vessel — e.g. the decks and cabin top — lies approximately co-planar with the water surface, then this tends to make the vessel stable in the inverted position, but with the craft riding stern low, for instance, the plane of the decks then being angled relative to that of the water surface, the craft can roll upright again more easily.

The release mechanism for the retraction of the float or floats of a vessel according to the invention can take a variety of forms other than those illustrated, whichever direction of pivoting is provided.

Figure 21:
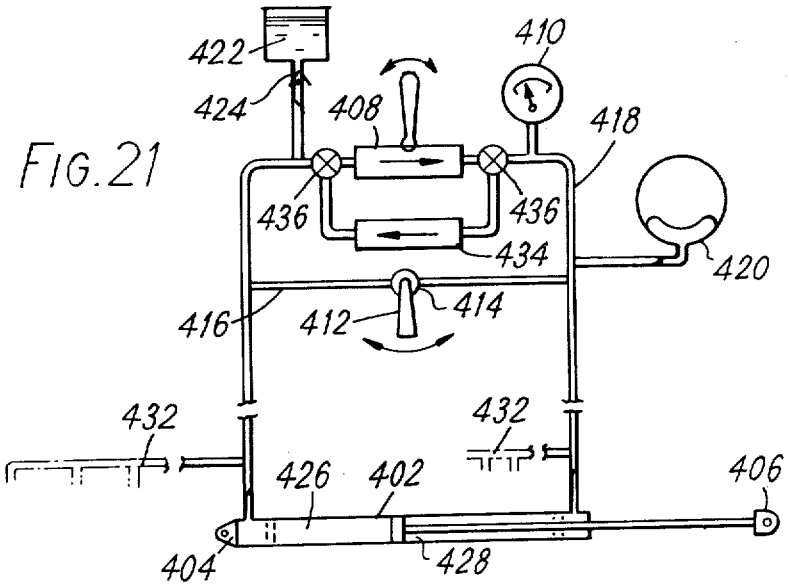
FIG. 21 is a schematic illustration of a hydraulic mechanism for use in a craft according to the invention.

For example, locking devices other than detects can be used, and if desired fluid pressure or electrical actuation can be provided for the release operation. An example of the use of hydraulic power operation is shown in FIG. 21, which illustrates a double-acting hydrauic ram 402 having its cylinder pivoted at 404 to the main hull and its piston rod pivoted at 406 to a float or float arm. Pressure fluid can be pumped by a main hand pump 408 in the direction arrowed on the pump, a pressure gauge 410 being mounted close to the pump in a centre position on the craft and in a prominent place where the crew will notice any loss of pressure. The float release operating mechanism comprises a pendulum weight 412 similarly to the example shown in FIGS. 10 and 11 mounted on a fore and aft axis to be sensitive to the heel of the craft and at the same or another central position on the craft to be readily accessible at all times. Pivoting with the weight 412 is a rotary valve 414 in a conduit 416 of the hydraulic circuit in parallel with the arm and wherein with the weight centrally positioned the valve is closed. Delivery line 418 from the pump 408 thus transmits pressure to an accumulator 420 and to the underside of the ram piston, causing the ram to contract. A make-up tank 422 is connected through check valve 424 to the line 418.

The rotary valve 414 is arranged to open on movement of the weight through a predetermined angle to either side of the central position and may be of generally known construction so that it need not be described in detail here. It may of course incorporate means for varying the angle at which it opens. The effect of the valve opening is to allow the buoyancy and weight of the floats to cause retraction of the floats. Also, pressure fluid is admitted to head 426 of the cylinder and since this acts on a larger area of the piston than the pressure fluid on the underside 428 of the piston, the ram will extend to displace the float arm from the extended position. The conduits of the circuit are of large bore to assist rapid action but the ram may comprise known means for buffering the end of the retraction stroke. The resulting increase of volume will be made up by pressure fluid from the accumulator 420. It will be recognised that the essential ingredients are present for retrction of a float automatically at a predetermined angle of heel. As will also be apparent from the branch conduits 432 shown in FIG. 21 it is possible to link any number of rams in parallel for their simultaneous operation by the fluid pressure changes transmitted through the respective conduits so that both floats can be retracted together and by rams at one or a plurality of points along the length of the floats.

For retraction of the floats in harbour, analogously to the winch-operated retraction mechanism of the earlier examples, an auxiliary hand pump 434 operating in the opposite direction to the pump 408 and in parallel therewith can be put in circuit in place of the pump 408 by use of the changeover valves 436.

It will be understood that opening the valve 414 permits the floats to retract under the action of their own weight and buoyancy and in some instances this can be relied on to drive the rams once the ends of each ram are interconnected when the craft is at large angles of heel but this effect cannot always be relied on in harbour to bring the floats to a retracted position if e.g. they must thereby be deeply immersed.

Figure 22:
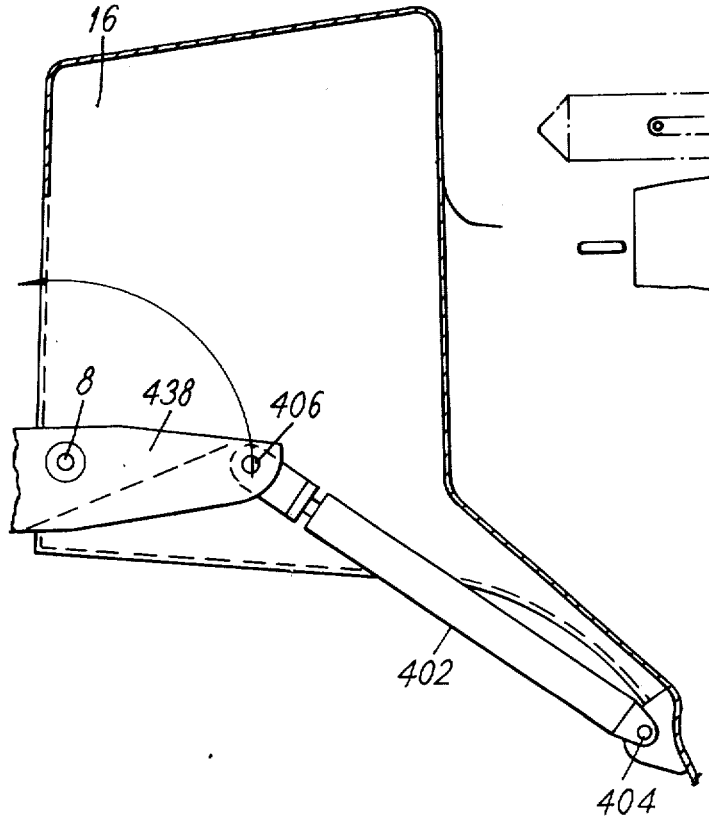

FIG. 22 illustrates the application of the mechanism to an inwardly and downwardly retracting float such as is used in the earlier embodiments described. Float arm 438 is rigidly fixed to its float (not shown) and is pivoted to the main hull at 8. The ram 402, pivoted to the hull at 404, has the pivot connection 406 of its piston rod on the float arm.

Figure 23:
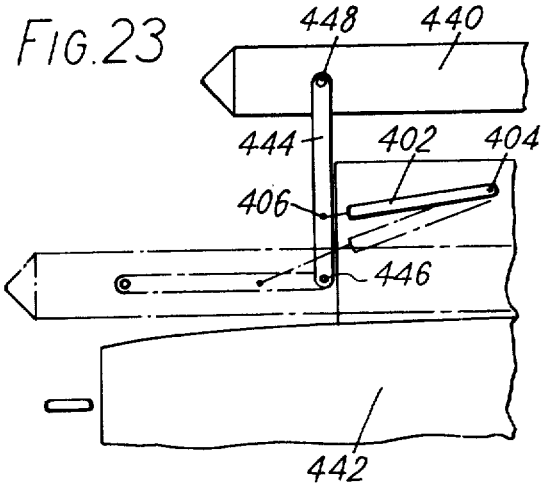
FIGS. 22 and 23 illustrate the application of the mechanism of FIG. 21 to two different forms of craft.

FIG. 23 illustrates the mechanism applied to a float 440 that is displaceable longitudinally to the dotted retraction position shown, the arrangement of the craft being similar to the example described with reference to FIGS. 18 and 19. The ram is attached to the hull 442 by its pivot 404 and its pivot 406 is attached to float arm 444 intermediate the arm pivots 446, 448 with the hull and the float respectively, so that as described in FIG. 21, retraction of the ram extends the float and extension of the ram retracts the float.

In both examples of FIGS. 22 and 23 the action of the rams when the valve 414 opens will both bias the floats towards their retracted positions and will hold them there. With the valve closed, operation of the hand pump will re-extend the floats. The automatic operation can of course be overriden if required by rotating the weight and valve manually so that it is also possible to retract the floats at any desired angle of heel.

In all instances, it is important that the mechanism provided should allow sure and quick retraction of the float or floats when the craft is underway and the release means should therefore be disposed at central positions on the craft so as to be easily and readily operated by the crew at their normal stations.

What I claim and desire to secure by Letters Patent is:

1. A trimaran comprising, in combination, a main hull and a pair of floats one to each side of the hull, pivot connection means between each float and the hull, the floats being displaceable on said pivot connection means between an outwardly extended position remote from the hull and a retracted position close to the hull, said pivot connection means being provided with locking means for maintaining the floats in their extended positions, means sensitive to the heel of the craft being disposed on the main hull and being operable on said locking means while the craft is underway for releasing the floats from said locking means for displacement to their retracted positions when said heel of the craft exceeds a predetermined value, the arrangement of the hull and the retracted floats being such that a self-righting moment is obtained between the buoyancy forces thereon and their gravity forces at large angles of heel, and means for extending the floats from said retracted positions and re-engaging said locking means.

2. A trimaran according to claim 1 wherein said pivot connection means comprise links having upwardly extending pivot axes whereby said movement between retracted and extended positions is accompanied by longitudinal displacement of the floats relative to the hull.

3. A trimaran according to claim 2 wherein each float is connected to the main hull through forward and rearward pivot links, said floats and said links defining with said hull a quadrilateral in which at least two opposed sides are obliquely disposed to each other.

4. A trimaran according to claim 1 wherein the floats are articulated to the main hull through pivot axes extending generally longitudinally and are displaceable to and from a downwardly and inwardly retracted position by rotation about said axes, said predetermined angle of heel for release of the locking means being less than 90°.

5. A trimaran according to claim 1 wherein the locking means for each float comprises an engagement element secured to the float, a detent, a pivot mounting for said detent secured to said hull, the detent being pivotable into and out of engagement with said engagement element, said heel-sensitive means comprising release means disposed inboard of the main hull remote from said detents and being connected to said detents for effecting movement of the detents to and from locking engagement with the respective floats while the floats are held in their extended positions.

6. A trimaran according to claim 5 comprising a fixed member of the hull adjacent each detent, said engagement elements being disposed between said members and the detents when the floats are extended, whereby said engagement elements are clamped therebetween for securing the floats in the extended position.

7. A trimaran according to claim 5 wherein for each detent said locking means comprise a locking device displaceably engageable with the detent to urge it to its operative position, resilient means urging the device away from said position of engagement with the detent, said release means permitting the movement of said device from the detent under the action of the resilient means, a connecting element being provided between said device and the detent whereby withdrawal of said device by the release means also displaces the detent to a position spaced from the float for permitting retraction of the float.

8. A trimaran according to claim 7 wherein said locking device comprises a main locking member that engages the detent in its operative position and a pilot locking member connected to said main member to be movable therewith, said resilient means acting between said pilot and main members for permitting displacement therebetween, whereby said pilot member first engages the detent to urge it towards its operative position whereafter said main member engages and secures the detent to lock the float in its extended position.

9. A trimaran according to claim 5 wherein a secondary location portion is provided on said detents for engagement with said float engagement elements for locating the floats in a partly extended mooring position.

10. A trimaran according to claim 5 comprising respective control connections to the detent for movement of the detent in opposite directions about its pivot whereby a force applied through one of the connections displaces the detent to the operative position and said release means act through the other connection to displace the detent from said position.

11. A trimaran according to claim 10 wherein the release means comprises a first controlling member, further follower members for the respective floats adjacent said first member being displaceable jointly by said controlling member to displace said detents from their operative positions, said further follower members being also displaceable separately for re-locating their respective detents in their operative positions.

12. A trimaran according to claim 5 wherein said locking means act on each float at a plurality of spaced positions along its length.

13. A trimaran according to claim 1 wherein said heel-sensitive means comprises a pendulum weight on a generally longitudinally directed pivot on the main hull.

14. A trimaran according to claim 1 wherein the heel-sensitive means for each float comprises a release device connected to the float locking means, and a holding device for engagement with said release device to secure it in a position that maintains said locking means operative to hold the float in the extended position, means for displacement of the holding device in dependence upon the heel of the craft for disengaging the float locking means at a predetermined angle of heel, the floats being acted on by their buoyancy and weight at least at angles of heel approaching 90° to urge them to retract as the locking means are released.

15. A trimaran according to claim 14 wherein resilient biasing means act on the float to supplement the action of said buoyancy and weight for causing the floats to retract.

16. A trimaran according to claim 13 wherein the heel-sensitive means for each float comprises a release device connected to the float locking means, and a holding device for engagement with said release device to secure it in a position that maintains said locking means operative to hold the float in the extended position, the holding device comprising a rotary member connected to said pendulum weight to be displaceable thereby, an element on said member providing the engagement with said release device and having an angular extent limited to a predetermined sectoral region of the member whereby rotation of the member beyond a predetermined angular limit disengages the release device from said element.

17. A trimaran according to claim 16 wherein means are provided for adjustment of the effective angular extent of said element.

18. A trimaran according to claim 1 further comprising retaining means for retaining the floats in their retracted positions and manually operable means for releasing said retaining means in order to re-extend the floats.

19. A trimaran according to claim 1 comprising a fluid pressure mechanism connected between the main hull and the floats and provided with heel-sensitive means for actuation of said mechanism to retract the floats.

20. A trimaran according to claim 19 wherein said mechanism comprises a plurality of rams connected between the main hull and the floats, means for urging said rams to a first end position in which they hold the floats extended and a gravity-operated valve device responsive to the heel of the craft for permitting the rams to move to their opposite end position to retract the floats when the craft exceeds a predetermined angle of heel, and crew-operated means for extending the floats.

21. A trimaran according to claim 1 comprising lanyard arrangements for the extension and retraction of the floats and winching means provided on the main hull for the operation of said arrangements.

22. A trimaran comprising a main hull and respective floats on opposite sides of the hull connected thereto through pivot connection means connecting the floats to the hull for permitting each float to move between a retracted position close to the hull and an extended position spaced away from the hull, each float being provided with locking means mounted on the main hull and holding the float against movement on said pivot connection means to maintain the float in its extended position, respective means extending from acentral location to the locking means of the respective floats for release of said locking means, an operating arrangement at said location for said releasing means, said operating arrangement comprising means responsive to the heel of the craft whereby the floats are released automatically upon capsize of the craft, and manual override means whereby the floats can be released manually from said location while the craft is underway, means producing a retracting force on each float at least when the float is submerged at angles of heel of the craft approaching 90° whereby said release in response to the heel of the craft causes it to move to said retracted position, the configuration of the hull and the floats producing a self-righting moment on the craft by the interaction of the buoyancy and gravity forces on the craft upon said retraction at said angles of heel, actuating means being provided on the craft and located for operation by the crew while the craft is underway for returning a retracted float to its extended position upon righting of the craft, and for retracting an extended float in harbour.

* * * * *